US005280324A

United States Patent [19]

Ono et al.

[11] Patent Number: 5,280,324

[45] Date of Patent: Jan. 18, 1994

[54] TONER CARTRIDGE

[75] Inventors: Hisao Ono; Yukio Ota; Hiroshi Kikuchi; Yoshiharu Momiyama; Shigeki Nakajima, all of Tokyo, Japan

[73] Assignee: Oki Electric Industry Co., Ltd., Tokyo, Japan

[21] Appl. No.: 838,402

[22] PCT Filed: Jul. 8, 1991

[86] PCT No.: PCT/JP91/00910

§ 371 Date: Mar. 9, 1992

§ 102(e) Date: Mar. 9, 1992

[87] PCT Pub. No.: WO92/01247

PCT Pub. Date: Jan. 23, 1992

[30] Foreign Application Priority Data

Jul. 10, 1990 [JP] Japan ..... 2-73039[U]

[51] Int. Cl.[5] ..... G03G 15/06

[52] U.S. Cl. ..... 355/260; 222/DIG. 1

[58] Field of Search ..... 355/202, 210, 260; 222/DIG. 1

[56] References Cited

U.S. PATENT DOCUMENTS

| | | | |
|---|---|---|---|
| 3,618,826 | 10/1971 | Kangas et al. | 222/DIG. 1 X |
| 4,034,701 | 7/1977 | Davidson et al. | 222/DIG. 1 X |
| 4,089,601 | 5/1978 | Navone | 222/DIG. 1 X |
| 4,441,636 | 4/1984 | Yamashita et al. | 222/DIG. 1 X |
| 4,688,926 | 8/1987 | Manno | 355/260 |
| 5,118,013 | 6/1992 | Mutou et al. | 222/DIG. 1 X |

FOREIGN PATENT DOCUMENTS

| | | | |
|---|---|---|---|
| 2354760 | 5/1975 | Fed. Rep. of Germany . | |
| 60-147770 | 8/1985 | Japan . | |
| 154274 | 8/1985 | Japan | 355/260 |
| 254067 | 12/1985 | Japan | 355/260 |
| 35383 | 2/1987 | Japan | 355/260 |
| 1-29655 | 2/1989 | Japan . | |
| 1-85750 | 6/1989 | Japan . | |
| 271783 | 12/1991 | Japan | 355/260 |
| 90/01189 | 2/1990 | World Int. Prop. O. . | |

*Primary Examiner*—A. T. Grimley
*Assistant Examiner*—J. E. Barlow, Jr.
*Attorney, Agent, or Firm*—Wenderoth, Lind & Ponack

[57] ABSTRACT

A detachable toner cartridge for use in an electrophotographic printer includes an outer cylinder and an inner cylinder contacting each other and having respective toner discharge outlets that can be overlapped with each other by turning the inner cylinder relative to the outer cylinder so as to discharge toner. The inner cylinder is pressed against the outer cylinder in the circumferential direction to bring the cylinders into close contact to prevent toner leakage. The toner cartridge does not require so high accuracy in manufacturing thereof.

17 Claims, 5 Drawing Sheets

TONER CARTRIDGE

BACKGROUND OF THE INVENTION

1. Technical Field

The present invention relates to a toner cartridge for feeding toner to electrophotographic recorders and the like.

2. Background Technology

Cylindrical toner cartridges have been known as conventional toner cartridges. A cartridge of this type is composed of an outer cylinder, an inner cylinder which rotatively contacts the inner surface of the outer cylinder and a pair of caps attached to opposite ends of the inner cylinder. The inner cylinder has an empty space therein to accommodate toner. A plurality of toner discharge outlets are defined in the side surface of the outer cylinder in the longitudinal direction thereof, while a plurality of toner discharge outlets also are defined in the side surface of the inner cylinder. The caps also are in contact with opposite ends of the outer cylinder, one of the caps having a toner filling opening which is usually equipped with a pug.

A method of filling toner in the toner cartridge set forth above will be described hereinafter. Firstly, the inner cylinder is rotated or turned relative to the outer cylinder so that the toner discharge outlets of the inner cylinder will not overlap the toner discharge outlets of the outer cylinder. Then the plug is removed from the toner filling opening and toner is filled into the toner cartridge. Thereafter the plug is put in the toner filling opening.

In order to feed the toner to an electrophotographic recorder using the toner cartridge which is filled with toner in the manner described above, the toner cartridge is attached to the electrophotographic recorder at a predetermined position thereof with the outer toner discharge outlets directed downwardly. Thereafter the inner cylinder is turned by a driving means so as to overlap the inner toner outlets with the outer toner outlets. As a result, the toner is fed to the electrophotographic recorder through the aligned and overlapped inner and outer toner discharge outlets.

The toner cartridge set forth above, however, has the following disadvantages. It is difficult to manufacture the inner and outer cylinders in a manner such that the inner cylinder contacts an inner surface of the outer cylinder and at the same time is rotatable with respect to the outer cylinder. When the outer diameter of the inner cylinder is manufactured to be less than the inner diameter of the outer cylinder, a gap is defined between the inner and outer cylinders. Such gap causes leakage therethrough of the toner. When the outer diameter of the inner cylinder is manufactured with high accuracy so as to conform to the inner diameter of the outer cylinder to prevent such leakage of the toner, the yield of the operation of manufacturing the inner cylinder is decreased, thereby increasing the cost of manufacturing the cartridge.

Previously proposed was a method of providing a cutaway portion at a part of the outer cylinder for facilitating the sliding motion of the inner cylinder when the outer diameter of the inner cylinder is manufactured to be the same as the inner diameter of the outer cylinder (Japanese Patent Application No. 1-122439). The cutaway portion is formed in the outer cylinder extending axially from opposite ends thereof but at positions where it does not overlap the toner discharge outlets of the outer and inner cylinders. Such cutaway portion, however, does not sufficiently reduce sliding friction between the outer and inner cylinders so that the turning of the inner cylinder remains difficult.

SUMMARY OF THE INVENTION

The object of the present invention is to solve the problems set forth above and to provide a toner cartridge which has a high performance and an easily turnable inner cylinder.

Furthermore, it is another object of the present invention to provide a toner cartridge which does not require high accuracy in manufacturing the outer and inner cylinders thereof.

The toner cartridge according to the present invention is composed of an outer cylinder, an inner cylinder having substantially the same length as that of the outer cylinder and caps to cover both opposite ends of the cylinders. The outer cylinder has openings at both ends thereof and has an outer toner discharge outlet extending in the longitudinal direction thereof. The inner cylinder has an inner discharge outlet extending in the longitudinal direction thereof and cap fitting portions at opposite ends thereof. The caps fit on the cap fitting portions. The inner cylinder is placed rotatably in contact with the inner surface of the outer cylinder, and the openings of the latter substantially conform to the cap fitting portions of the former.

The inner cylinder of the toner cartridge according to the present invention is composed of a flexible member and has a partially cutaway cylindrical shape, i.e. a C-shaped cross section. An inner toner discharge outlet is defined at a partially cutaway portion of the inner cylinder, namely, radially between opposite circumferentially spaced ends of the inner cylinder. The circumferentially spaced ends of the inner cylinder are brought into contact with the inner wall surface of the outer cylinder by applying pressure thereto in the circumferential direction of the inner cylinder.

Consequently, gaps are prevented from occurring between the circumferentially spaced ends of the inner cylinder and the inner wall surface of the outer cylinder, thus eliminating leakage therebetween of toner. Since the inner cylinder is made of flexible member and is formed to be C-shaped in cross section, it is possible to manufacture toner cartridges at a high yield, while preventing formation of gaps between the cylinders or without increasing the rotational load due to the variations of dimensions of the cylinders.

DETAILED DESCRIPTION OF THE INVENTION

First Embodiment

Figure 1:
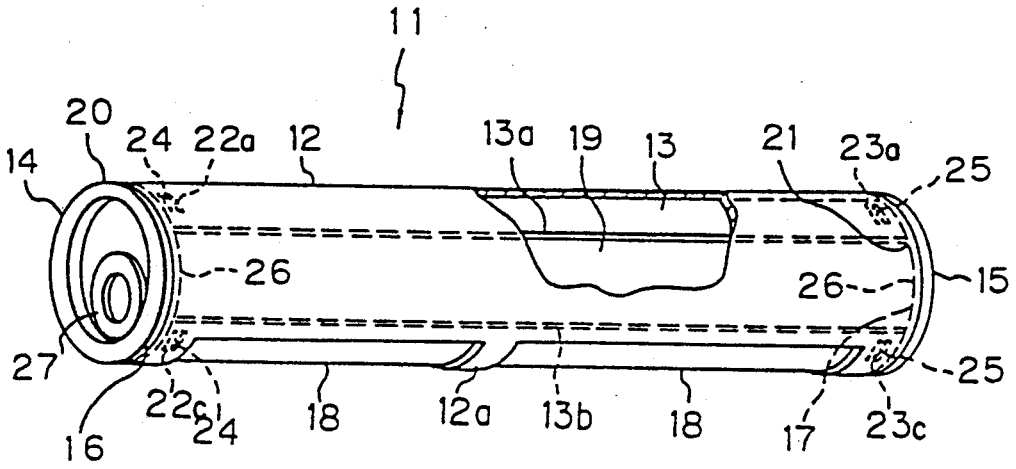
FIG. 1 is a partially cutaway perspective view of a toner cartridge according to a first embodiment of the present invention.

A toner cartridge according to the first embodiment of the present invention will be described with reference to the partially cutaway perspective view of FIG. 1. The toner cartridge 11, as shown in FIG. 1, comprises an outer cylinder 12, an inner cylinder 13 and end caps 14 and 15.

The outer cylinder 12 is composed of a thin plate. Openings 16 and 17 are defined at opposite ends of the outer cylinder 12. A plurality of outer toner discharge openings or outlets 18 are formed radially through the outer cylinder 12 and extend in the longitudinal direction thereof. Denoted at 12*a* is an outer cylinder rib between adjacent outlets 18.

Figure 2:
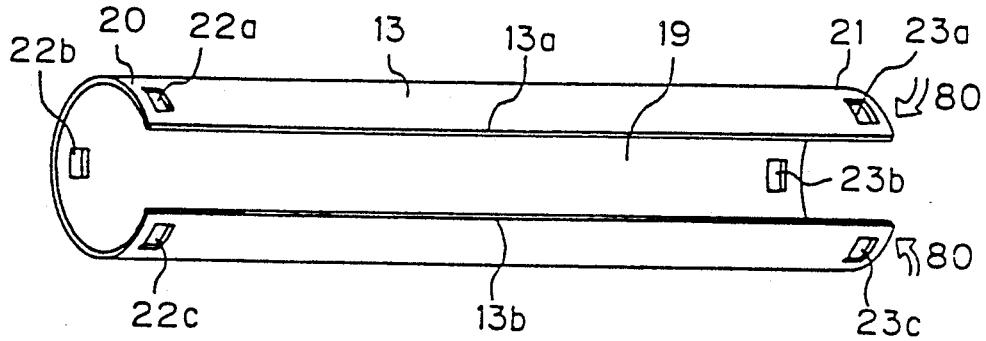
FIG. 2 is a perspective view showing an inner cylinder of the toner cartridge according to the first embodiment.

On the other hand, the inner cylinder 13 is composed of a flexible and outwardly resilient plate that is resiliently bendable in the directions of the arrows 80 as illustrated in FIG. 2. The inner cylinder 13 has a substantially C-shaped cross section. The resilience of the inner cylinder 13 is used to apply a pressure to the inner cylinder 13 radially thereof and around the inner circumference thereof. The inner cylinder 13 opposite axially extending circumferential ends 13*a* and 13*b* which form therebetween a gap serving as an inner toner discharge outlet 19. The length of the inner toner discharge outlet 19 in the circumferential direction is defined to be substantially the same as that of the outer toner discharge outlets 18 described above.

Figure 3:
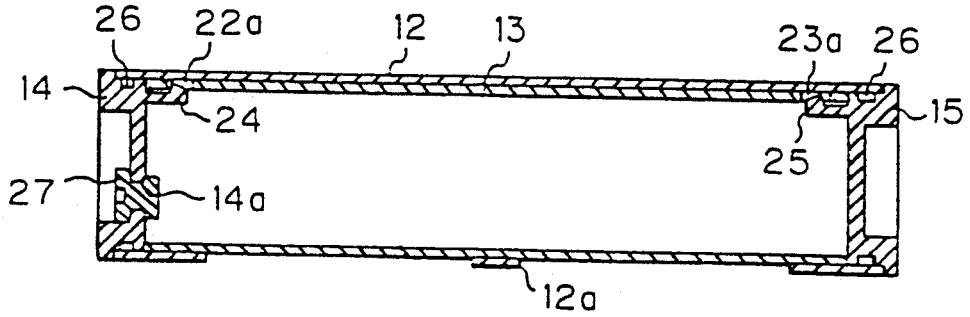
FIG. 3 is a longitudinal cross section of the toner cartridge according to the first embodiment.

The inner cylinder 13 has cap fitting portions 20 and 21 at both longitudinal ends thereof Furthermore, holes 22*a*, 22*b* and 22*c* are defined in the cap fitting portion 20 while holes 23*a*, 23*b* and 23*c* are defined in the cap fitting portion 21. The inner cylinder 13 is turnably in contact with and pressed against the inner surface of the outer cylinder 12 at least at the circumferential ends 13*a* and 13*b* thereof. The caps 14 and 15 are fixed to the cap fitting portions 20 and 21 by inserting pawls 24 and 25 protruding from the caps 14 and 15, respectively, into the corresponding holes 22*a*, 22*b*, 22*c*, 23*a*, 23*b* and 23*c* respectively as illustrated in FIG. 3. The caps 14 and 15 have seals 26 formed of elastic members on the outer circumferences thereof which closely contact the inner surface of the outer cylinder 12 so as to prevent toner, not shown, from leaking through the sides of the caps 14 and 15. The cap 14 has a toner filling inlet 14*a* into which fits a plug 27.

In order to fill toner into the thus constructed toner cartridge 11, the inner cylinder 13 is turned to a position where the inner toner discharge outlet 19 and the outer toner discharge outlets 18 do not overlap each other in the same manner as employed in the conventional method. The inner cylinder 13 can be turned by turning the caps 14 and 15 relative to outer cylinder 12 Thereafter the plug 27 is removed from the toner filling inlet 14*a*, toner is filled into the toner cartridge through the toner filling inlet 14*a*, and then the plug 27 is replaced.

The operation of discharging the toner from the toner cartridge 11 will be described with reference to the cross sectional views of FIGS. 4(*a*) and 4(*b*).

Figure 4A:
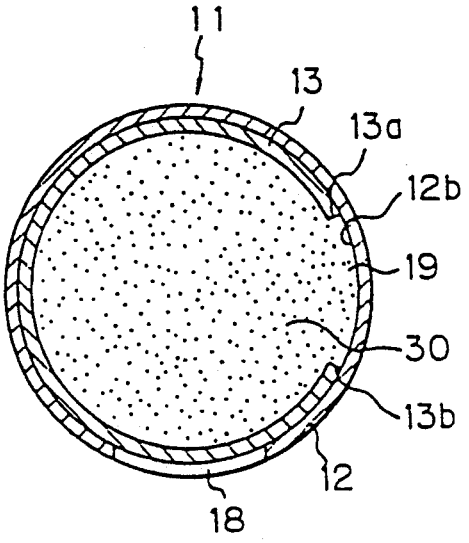
FIGS. 4(*a*) and 4(*b*) are lateral cross sections of the toner cartridge showing operation of the first embodiment.
Figure 4B:
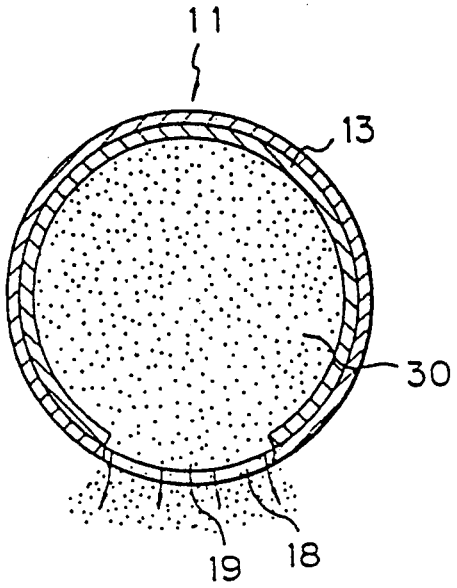

As shown in FIG. 4(*a*), the inner cylinder 13 is turned to the position where the inner toner discharge outlet 19 of the inner cylinder 13 and the outer toner discharge outlets 18 of the outer cylinder 12 do not overlap each other, e.g. the former is turned to extend at 90° relative to the latter, and then toner 30 is filled into the toner cartridge 11. At this time, the circumferential ends 13*a* and 13*b* of the inner cylinder 13 are brought into close contact with the inner surface 12*b* of the outer cylinder 12 so that no gaps are created between the circumferential ends 13*a* and 13*b* of the inner cylinder 13 and the inner surface 12*b* of the outer cylinder 12, and the toner 30 cannot leak therebetween. In order to discharge the toner 30 from the toner cartridge 11 filled therein, the inner cylinder 13 is turned relative to outer cylinder 12. Cylinder 13 turns smoothly as it can freely move radially. As shown in FIG. 4(*b*), the inner toner discharge outlet 19 and the outer toner discharge outlets 18 are caused to be substantially overlapped with each other, and the toner 30 is discharged therethrough.

Inasmuch as the inner cylinder 13 of the toner cartridge 11 is formed of a bent elastic plate which closely contacts the inner surface of the cylinder 12 by its resilience, it need not be manufactured to be of high dimensional accuracy. As a result, the manufacturing cost of cartridge 11 is reduced.

Second Embodiment

Figure 5:
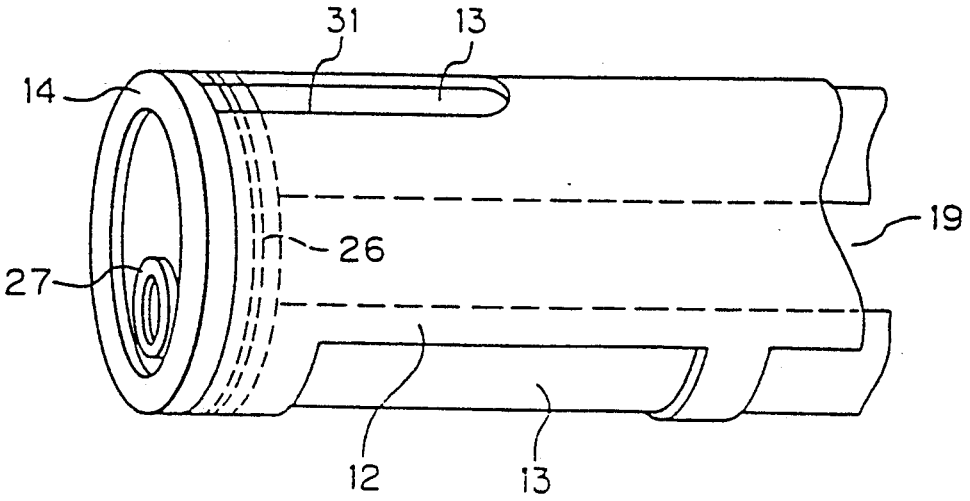
FIG. 5 is a partial perspective view of a toner cartridge according to a second embodiment.

Although the outer cylinder 12 employed in the first embodiment of the present invention does not so include, it is possible to provide the outer cylinder with a cutaway portion such as described in the foregoing BACKGROUND TECHNOLOGY, i.e. as disclosed in Japanese Patent Application No. 1-122439. FIG. 5 is a partially cutaway perspective view of the toner cartridge according to the second embodiment incorporating such feature.

Thus, a cutaway portion 31 is defined in outer cylinder 12 at a position where portion 31 does not overlap the inner toner discharge outlet 19 even when the inner cylinder 13 is turned. In the second embodiment, the inner cylinder 13 also is formed of a bent elastic plate which is radially pressed against the outer cylinder 12 by the resilience of inner cylinder 13.

Third Embodiment

Figure 6:
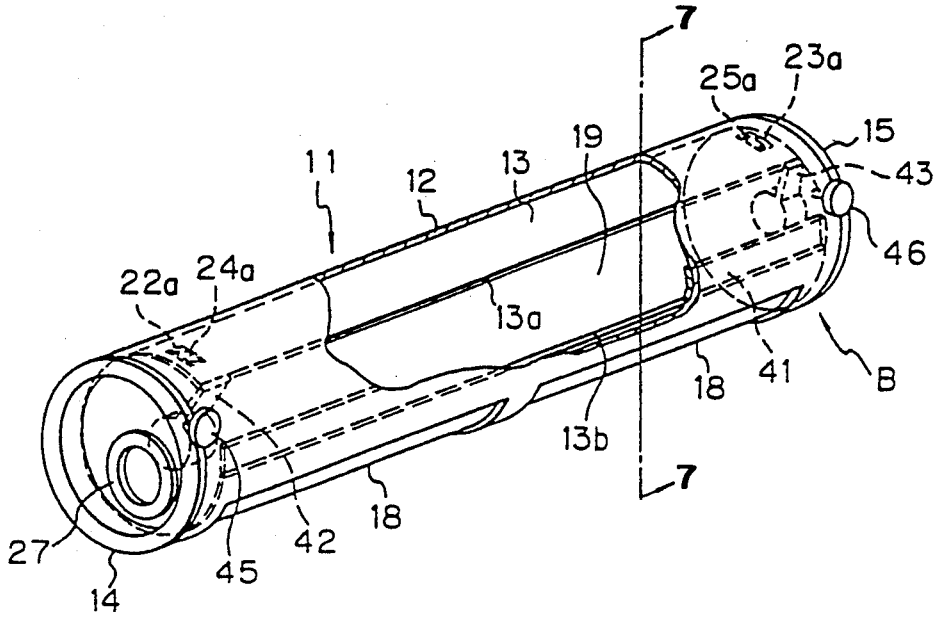
FIG. 6 is a partially cutaway perspective view of a toner cartridge according to a third embodiment.
Figure 7:
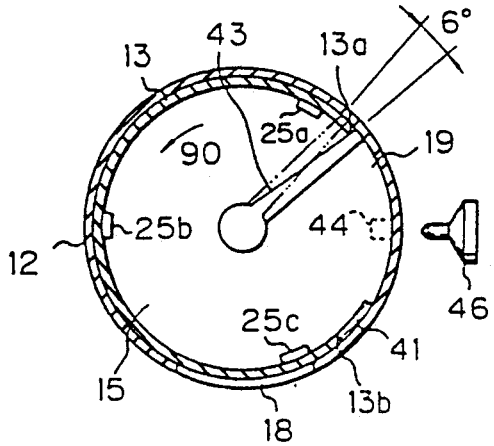
FIG. 7 is a cross-sectional view of FIG. 6 taken along line 7—7 therein.
Figure 8:
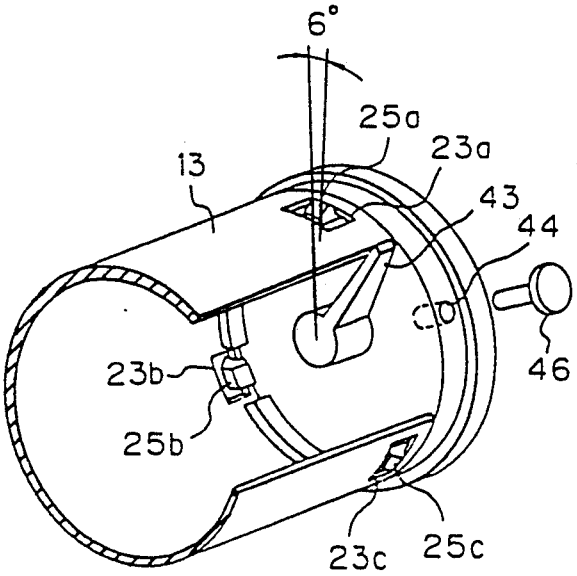
FIG. 8 is a perspective view of a B portion of FIG. 6 omitting an outer cylinder.

The third embodiment of the present invention will be described with reference to FIG. 6 to FIG. 8. In such figures, components which are the same as illustrated in FIG. 1 are denoted by the same numerals.

According to the third embodiment, the outer cylinder 12 has a stopper or abutment member 41 at a position on the inner surface of the outer cylinder 12 to be abutted by and to stop the circumferential end 13*b* of the inner cylinder 13. The stopper 41 is provided to stop the inner cylinder 13 at a position where the outer toner discharge outlets 18 of the outer cylinder 12 and the inner toner discharge outlet 19 of the inner cylinder 13 do not overlap each other. The stopper 41 has substantially the same length as that of the inner cylinder 13 in the longitudinal direction, and has the same thickness as that of the inner cylinder 13. Therefore, a toner stirring member, not shown, may rotatably contact the inner surface of the inner cylinder 13.

Adjacent opposite longitudinal ends of the inner cylinder 13 are formed holes 22*a*, 22*b*, 22*c*, 23*a*, 23*b* and 23*c* that are engaged by pawls 24*a*, 24*b*, 24*c*, 25*a*, 25*b* and 25*c* of caps 14 and 15, as in the first embodiment. Gaps are defined between each circumferential edge of each such hole and the corresponding circumferential edges of the respective pawls. Thus, the pawls can be moved relative to inner cylinder 13 by about 6° upon turning of the caps 14 and 15.

The caps 14 and 15 have respective projecting members 42 and 43 fixedly mounted thereon at central portions thereof and extend radially therefrom to the outer circumference of inner cylinder 13. Consequently, the caps 14 and 15 are integrally formed both with the pawls and the projecting members. When, for example, the cap 15 is turned in the direction of the arrow 90 in FIG. 7, the pawls 25*a*, 25*b* and 25*c* can rotate relative to inner cylinder 13 in the same direction by as much as 6° and such turning force also is applied to the projecting member 43. One circumferential end 13*a* of the inner cylinder 13 contacts the projecting member 43, and the other end 13*b* thereof is stopped by the stopper 41. Therefore, such rotation of cap 15 causes member 43 to move end 13*a* in such turning direction, but member 43 is allowed to yield elastically as shown in FIG. 7. That is, when the cap 15 is turned in the direction of the arrow 90, the pawls 25*a*, 25*b* and 25*c* also turn by about 6° and the projecting member 43 is moved by about 6° in the turning direction, so as to push the circumferential end 13*a* of the inner cylinder 13 in the circumferential direction thereof. As a result, the inner cylinder 13 is radially expanded so that it is brought into even further close contact with the inner surface of the outer cylinder 12. At such state, pins 45 and 46 are inserted through fixing holes (not shown) provided in the outer cylinder 12 and into fixing holes 44 provided in the side surface of the cap. Thereby, it is possible to fixedly mount the caps 14 and 15 to the outer cylinder 12.

For feeding toner to an electrophotographic recorder, firstly an operator moves pins 45 and 46 so that the inner cylinder 13 and the caps 14 and 15 can be rotated relative to the outer cylinder 12. Thereafter, the operator installs the toner cartridge 11 in the electrophotographic recorder (not shown) and turns the caps 14 and 15 in a direction reverse to the arrow 90. Consequently, the pawls integral with the caps 14 and 15 turn the inner cylinder 13 due to engagement with edges of the holes. As a result, the inner toner discharge outlet 19 of the inner cylinder 13 and the outer toner discharge outlets 18 of the outer cylinder 12 are overlapped each other, so that the toner is fed therethrough to the electrophotographic recorder.

According to the third embodiment, the projecting members 42 and 43 are resiliently bendable and push the inner cylinder 13 in the circumferential direction thereof so that the inner cylinder is moved into even further close contact with the outer cylinder.

Fourth Embodiment

Figure 9:
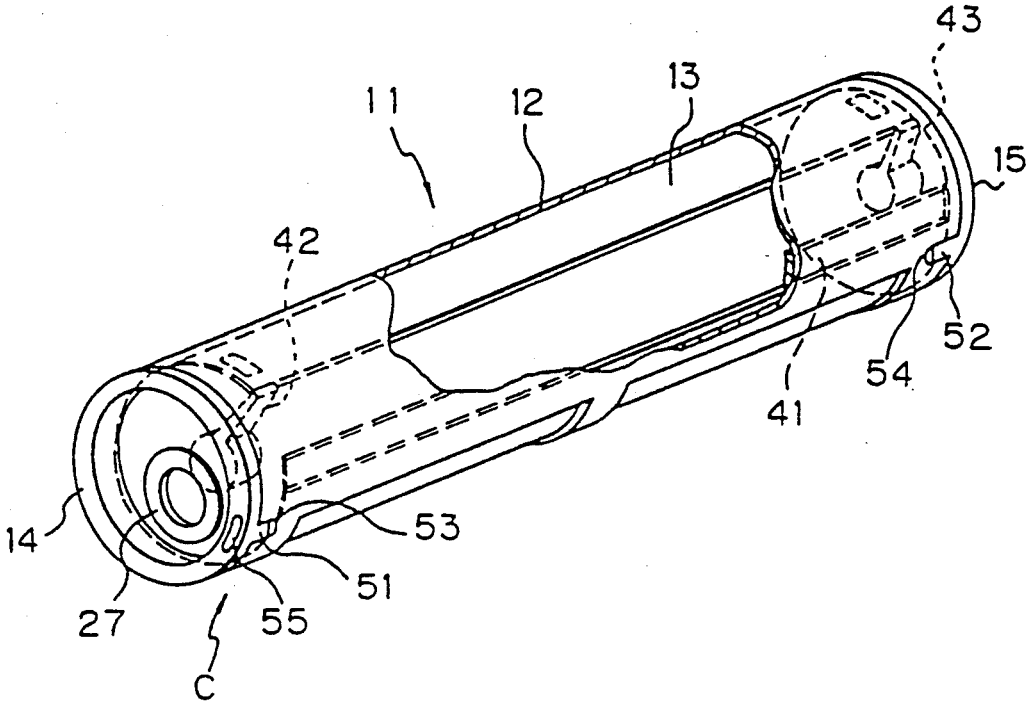
FIG. 9 is a partially cutaway perspective view of a toner cartridge according to a fourth embodiment.

The fourth embodiment is substantially the same as the third embodiment. FIG. 9 is a partially cutaway perspective view of the toner cartridge according to the fourth embodiment, wherein the same components are denoted by the same numerals and illustration thereof is partially omitted.

Figure 10:
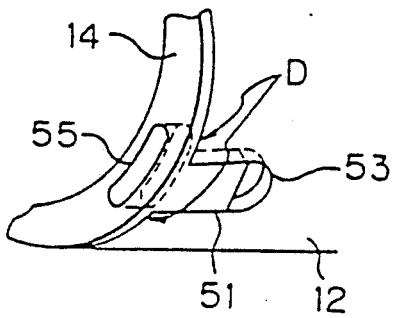
FIG. 10 is an enlarged view of a C portion of FIG. 9.

The third embodiment employed the pins 45 and 46 to fix the caps 14 and 15 to the outer cylinder while the fourth embodiment employs easily destructible projections. That is, the caps 14 and 15 are equipped on the outer circumferences thereof with projections 51 and 52. The projections 51 and 52 engage in cutaway portion 53 and 54, respectively, provided in ends of the outer cylinder 12 at positions corresponding to the projections. Furthermore, a groove 55 is provided in the outer surface of the cap 14 so as to facilitate the breaking of the projection 51, as illustrated in FIG. 10. Thus, the projection 51 is broken at portion D in FIG. 10, so that the cap becomes rotatable relative to the outer cylinder. In order to feed toner to the electrophotographic recorder, the operator breaks the projections 51 and 52 to make the caps rotatable, and thereafter carries out the operation of feeding toner in the same manner as in the third embodiment.

Fifth Embodiment

Figure 11:
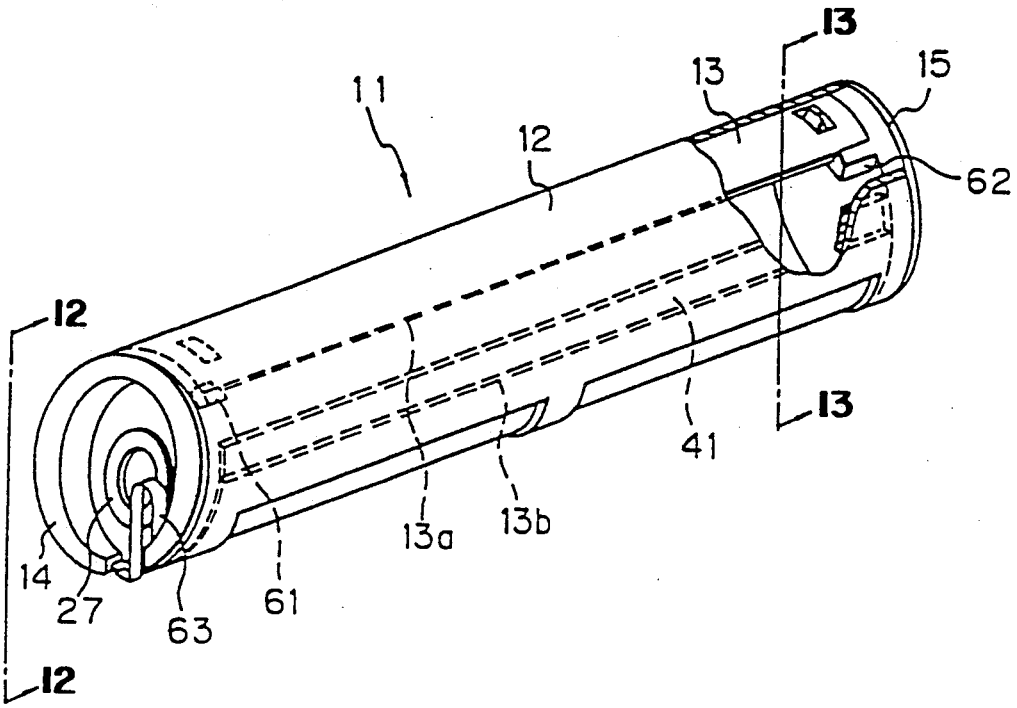
FIG. 11 is a partially cutaway perspective view of a toner cartridge according to a fifth embodiment.
Figure 12:
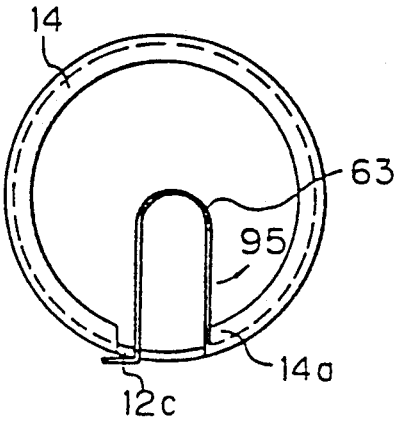
FIG. 12 is a view as viewed from the arrows 12—12 of FIG. 11, with a cap of FIG. 11 omitted.
Figure 13:
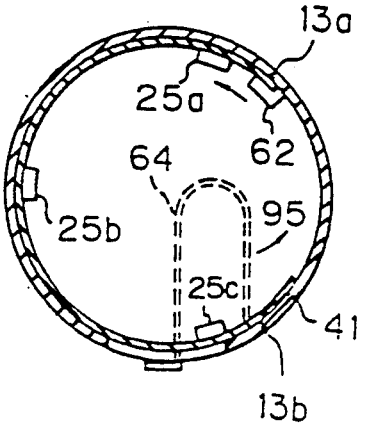
FIG. 13 is a cross-sectional view taken along the line 13—13 of FIG. 11.

The toner cartridge according to the fifth embodiment will be described with reference to FIG. 11 to FIG. 13. The same components as in FIG. 1 are denoted by the same numerals. According to the fifth embodiment, stoppers 61 and 62 are provided integrally with the caps 14 and 15 to extend inwardly of outer cylinder 12 As a result, the inner cylinder 13 is held between the stoppers 61 and 62 at the end 13*a* of the inner cylinder and the stopper 41 of the outer cylinder 12 at the other end 13*b* of the inner cylinder. On the other hand, leaf springs 63 and 64 are provided at the edges of the caps 14 and 15. Leaf spring 63 is detachably provided so that one end thereof engage an end portion 12*c* of the outer cylinder 12 and the other end thereof engages an edge portion 14*a* of the cap 14. Spring 63 thus can turn the cap 14 in the direction of arrow 95 relative to the outer cylinder 12 as illustrated in FIG. 12. The leaf spring 64 is also disposed in the same manner as the leaf spring 63, and turns the cap 15 in the direction of arrow 95 shown in FIG. 13. The stoppers 61 and 62 push the end portion 13*a* of the inner cylinder 13 in the circumferential direction thereof as the caps 14 and 15 are turned. Thus the leaf springs 63 and 64 push the end portion 13*a* of the inner cylinder 13 in the circumferential direction thereof, so that the inner cylinder 13 is brought into even closer contact with the outer cylinder 12.

In order to feed toner to the electrophotographic recorder, the operator removes the leaf springs 63 and 64 so as to make the caps rotatable, and thereafter carries out the toner feeding operation in the same manner as described in the foregoing embodiments.

Inasmuch as the detachable leaf springs are employed in the fifth embodiment, the projection 42 and 43 need not be provided for generating a pushing force as in the third and fourth embodiments. Thus, the structure of the toner cartridge can be simplified. The two leaf springs 63 and 64 can be of the same shape, which facilitates the assembling operation owing to symmetry of the springs.

As described above, the toner cartridge according to the present invention is adapted for use in electrophotographic printers or duplicators which employ an LED, a laser beam, etc., as a light source for forming a static latent image, particularly to small and economical electrophotographic printers.

We claim:

1. A toner cartridge comprising:

an outer cylinder having therethrough a radially opening outer toner discharge outlet;

an inner toner receiving cylinder positioned within said outer cylinder for circumferential rotation relative thereto, said inner cylinder comprising an elastic member having a C-shaped configuration in transverse cross section and having circumferentially spaced first and second opposite axially extending ends defining therebetween an inner toner discharge outlet;

end caps closing axially opposite ends of said inner and outer cylinders;

connecting means for interlocking said end caps to said inner cylinder, whereby rotation of said end caps relative to said outer cylinder results in circumferential rotation of said inner cylinder relative to said outer cylinder, thus bringing said inner and outer toner discharge outlets into and out of alignment; and means for urging said inner cylinder radially outwardly into toner sealing contact with said outer cylinder, said inner cylinder being formed of a bent elastic plate having outward resilience, and said urging means comprising said resilience.

2. A cartridge as claimed in claim 1, wherein said outer cylinder has cut-outs formed in opposite end portions thereof.

3. A cartridge as claimed in claim 1, wherein said connecting means comprise holes formed in opposite end portions of said inner cylinder, and pawls projecting from said end caps into respective said holes.

4. A cartridge as claimed in claim 1, further comprising seals positioned circumferentially around said end caps and contacting an inner surface of said outer cylinder.

5. A toner cartridge comprising:

an outer cylinder having therethrough a radially opening outer toner discharge outlet;

an inner toner receiving cylinder positioned within said outer cylinder for circumferential rotation relative thereto, said inner cylinder comprising an elastic member having a C-shaped configuration in transverse cross section and having circumferentially spaced first and second opposite axially extending ends defining therebetween an inner toner discharge outlet;

end caps closing axially opposite ends of said inner and outer cylinders;

connecting means for interlocking said end caps to said inner cylinder, whereby rotation of said end caps relative to said outer cylinder result sin circumferential rotation of said inner cylinder relative to said outer cylinder, thus bringing said inner and outer toner discharge outlets into and out of alignment; and means for maintaining a first said axially extending end of said inner cylinder circumferentially fixed relative to said outer cylinder, and means for moving said second axially extending end of said inner cylinder circumferentially relative to said outer cylinder, thereby brining an outer surface of said inner cylinder into tight contact with an inner surface of said outer cylinder.

6. A cartridge as claimed in claim 5, wherein said maintaining means comprises a stopper projecting inwardly of said inner surface of said outer cylinder to be abutted by said first axially extending end of said inner cylinder.

7. A cartridge as claimed in claim 6, wherein said moving means comprise members projecting axially inwardly from said end caps and abutting said second axially extending end of said inner cylinder.

8. A cartridge as claimed in claim 7, wherein said members each have a rigid inner portion integral with a center of the respective said end cap and an elastic portion extending outwardly form said rigid portion and abutting said second axially extending end of said inner cylinder, and further comprising fixing means for maintaining said tight contact between said outer surface of said inner cylinder and said inner surface of said outer cylinder.

9. A cartridge as claimed in claim 8, wherein said fixing means comprises holes formed in end portions of said outer cylinder and in said end caps, and pins extending into said holes and maintaining said end caps circumferentially fixed relative to said outer cylinder.

10. A cartridge as claimed in claim 8, wherein said fixing means comprise grooves formed in end portions of said outer cylinder, and destructible projections extending from said end caps into said grooves.

11. A cartridge as claimed in claim 8, wherein said elastic portion of each said member is bendable circumferentially by approximately 6° relative to said rigid inner portion.

12. A cartridge as claimed in claim 7, wherein said moving means further comprises spring means operable between said end caps and opposite ends of said outer cylinder.

13. A cartridge as claimed in claim 12, wherein said members comprise rigid stoppers.

14. A cartridge as claimed in claim 12, wherein said spring means comprise leaf springs having first ends acting on respective ends of said outer cylinder and second ends acting on respective said end caps.

15. A cartridge as claimed in claim 8, wherein said leaf springs are mounted detachably.

16. A cartridge as claimed in claim 14, wherein said leaf springs have identical configurations.

17. A cartridge as claimed in claim 6, wherein said stopper has an axial length and a thickness equal to those of said inner cylinder.

* * * * *